US005722821A

United States Patent [19]

Christenson

[11] Patent Number: 5,722,821

[45] Date of Patent: *Mar. 3, 1998

[54] BURNER ASSEMBLY FOR REDUCING NITROGEN OXIDES DURING COMBUSTION OF GASEOUS FUELS

[75] Inventor: Dan L. Christenson, Mulvane, Kans.

[73] Assignee: Gordon-Piatt Energy Group, Inc., Winfield, Kans.

[ * ] Notice: The term of this patent shall not extend beyond the expiration date of Pat. No. 5,441,404.

[21] Appl. No.: 513,336

[22] Filed: Aug. 10, 1995

Related U.S. Application Data

[63] Continuation of Ser. No. 11,455, Jan. 29, 1993, Pat. No. 5,441,404.

[51] Int. Cl.[6] ..... F23D 14/20

[52] U.S. Cl. ..... 431/10; 431/187; 431/115

[58] Field of Search ..... 431/5, 8, 10, 187, 431/159, 350, 202, 115, 116

[56] References Cited

U.S. PATENT DOCUMENTS

| | | | |
|---|---|---|---|
| 3,873,671 | 3/1975 | Reed et al. | 423/235 |
| 3,911,083 | 10/1975 | Reed et al. | 423/235 |
| 4,021,186 | 5/1977 | Tenner | 431/10 |
| 4,087,235 | 5/1978 | Ito et al. | 431/174 |
| 4,095,929 | 6/1978 | McCartney | 431/19 |
| 4,405,587 | 9/1983 | McGill et al. | 423/235 |
| 4,496,306 | 1/1985 | Okigami et al. | 431/8 |
| 4,519,993 | 5/1985 | McGill et al. | 423/235 |
| 4,573,906 | 3/1986 | Schwartz et al. | 431/202 |
| 4,604,048 | 8/1986 | Schwartz et al. | 431/8 |
| 4,815,966 | 3/1989 | Janssen | 431/174 |
| 5,044,932 | 9/1991 | Martin et al. | 431/116 |
| 5,073,105 | 12/1991 | Martin et al. | 431/116 |
| 5,135,387 | 8/1992 | Martin et al. | 431/116 |
| 5,195,884 | 3/1993 | Schwartz et al. | 431/8 |
| 5,238,395 | 8/1993 | Schwartz et al. | 431/10 |
| 5,275,552 | 1/1994 | Schwartz et al. | 431/10 |
| 5,284,438 | 2/1994 | McGill et al. | 431/9 |
| 5,441,404 | 8/1995 | Christenson | 431/187 |

FOREIGN PATENT DOCUMENTS

| | | | |
|---|---|---|---|
| 0076036 | 4/1983 | European Pat. Off. | F23C 6/04 |
| 194514 | 3/1905 | Germany . | |
| 55-17291 | 2/1980 | Japan . | |

*Primary Examiner*—Carl D. Price

*Attorney, Agent, or Firm*—Bill D. McCarthy; Phillip L. Free, Jr.; Randall K. McCarthy

[57] ABSTRACT

A process and diluent injection burner apparatus is provided which is capable of reducing the nitrogen oxide content in a combustion effluent, the diluent injection burner assembly provided with a burner head having an air flow passage extending therethrough and primary and secondary fuel dispensing nozzles supported within the airflow passageway and adapted to inject fuel into a peripheral downstream end portion of the burner head. A diluent manifold assembly is supported by the burner head such that upon combustion of the fuel diluent is tangentially injected into the peripheral downstream end portion of the burner head relative to a flame envelope produced by ignition of the primary and secondary fuel so that a diluent shroud is formed about a base portion of the flame envelope.

14 Claims, 2 Drawing Sheets

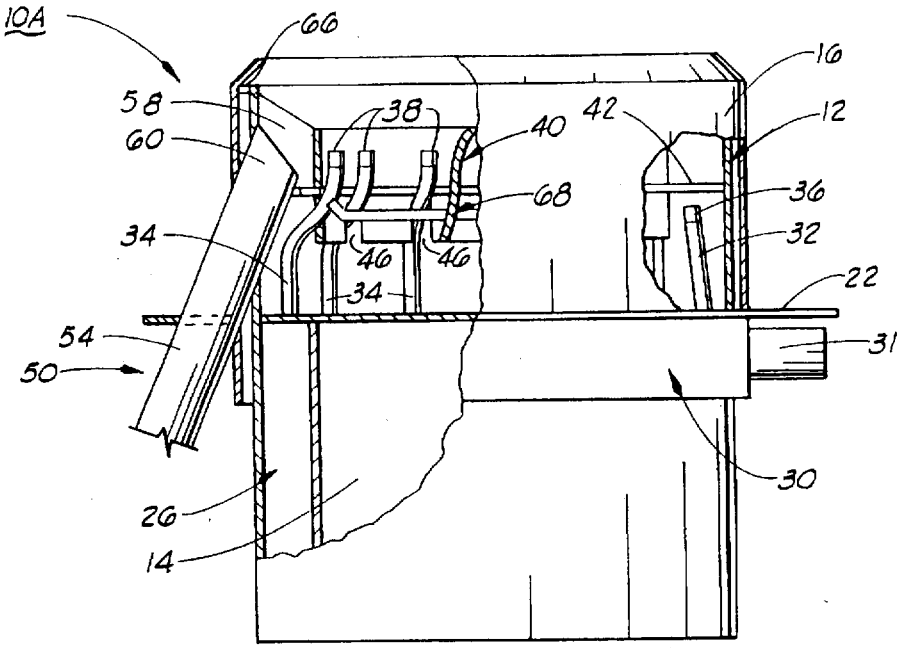
FIG. 4
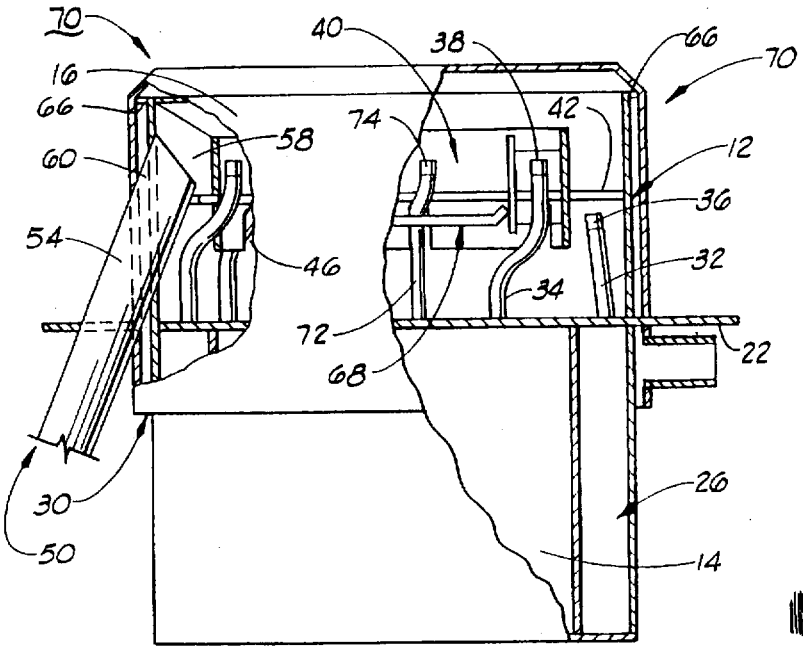
FIG. 5
FIG. 6

BURNER ASSEMBLY FOR REDUCING NITROGEN OXIDES DURING COMBUSTION OF GASEOUS FUELS

This is a continuation of application Ser. No. 08/011,455 filed on Jan. 29, 1993 now U.S. Pat. No. 5,441,404.

BACKGROUND OF THE INVENTION

1. Field of the Invention

The present invention relates to the field of combustion equipment, and more particularly but not by way of limitation, to a burner assembly which substantially reduces the nitrogen oxide content of a combustion effluent from a boiler or the like.

2. Description of the Prior Art

Waste gases containing oxides of nitrogen are produced during the combustion of gaseous fuels. Tightening state and federal emission requirements have led to considerable efforts to find ways to remove or prevent the formation of nitrogen oxides in combustion processes so that such gases may be discharged to the atmosphere without a deleterious effect on the environment.

The majority of the prior art has been directed to the removal or the abatement of nitrogen oxides in the combustion of industrial waste gas streams so that stack gases can be discharged into the atmosphere without harm to the environment. For example, it has been proposed that nitrogen oxides be removed from waste streams with a medium capable of absorbing the nitrogen oxides. However, problems are encountered when using an absorption medium in that acidic liquids or other nitrogen containing noxious liquids may be formed which must be subjected to further treatment before they can be safely discharged into the environment.

Other prior art processes employed to remove or prevent formation of nitrogen oxides during combustion of industrial waste streams have utilized various types of catalysts or chemical compounds to selectively reduce the nitrogen oxides; or such processes have employed the concept of reducing the nitrogen oxides in the presence of excess hydrocarbon at elevated temperatures.

Much work has also been done in the modification of industrial burner assemblies. That is, the burner assemblies have been modified to accommodate staged fuel and/or staged air, as well as to employ recirculated flue gas as a coolant/diluent.

While many of the prior art systems have been successful in the reduction of nitrogen oxides during the combustion of industrial waste streams, such processes have generally been designed for large scale combustion operations and require expensive and complicated equipment, or extreme modification of existing equipment. That is, most of the attention has been directed to large scale combustion processes and equipment for industrial waste streams, while the problem of nitrogen oxide reduction in effluents from smaller scale equipment, such as boilers and the like, has not received as much attention. Thus, a need remains for economical combustion equipment and processes which employ modifications of existing combustion equipment for boilers and the like, which eliminate the deficiencies of the prior art burner assemblies, which operate safely and which are capable of reducing the amount of nitrogen oxides present in the combustion effluent produced by the operation of such burners.

SUMMARY OF THE INVENTION

The present invention provides a process and diluent injection burner apparatus for reducing the nitrogen oxide content in the combustion effluent to less than about 25 ppm. The diluent injection burner apparatus is provided with a burner head having an air flow passage extending therethrough, and primary and secondary fuel supply nozzles are supported within the air flow passageway to inject fuel into a peripheral downstream end portion of the burner head. A diluent manifold assembly is supported by the burner head such that, upon ignition of the fuel, diluent is tangentially injected into the peripheral downstream end portion of the burner head relative to the flame envelope produced by ignition of the primary and secondary fuel so that a diluent shroud is formed about a base portion of the flame envelope. To control air flow through the air flow passage, as well as to provide stability to the flame envelope, a diffuser plate is disposed within the air flow passage.

An object of the present invention is to effectuate substantial reduction of oxides of nitrogen in a combustion effluent of a boiler or the like.

Another object of the present invention, while achieving the above-stated object, is to provide a burner apparatus for combustion of gaseous fuels for use with boilers and the like which eliminates the deficiencies of the prior art burner assemblies, which is capable of reducing the amount of nitrogen oxides present in the combustion effluent, which operates safely, and which is economical to manufacture and maintain.

Other object, features and advantages of the present invention will become clear from the following detailed description when read in conjunction with the drawings and appended claims.

BRIEF DESCRIPTION OF THE DRAWINGS

FIG. 4 is a semi-detailed, partially cutaway elevational view of a modified diluent injection burner apparatus of FIG. 1 having an air diffuser member.

FIG. 5 is a semi-detailed partially cutaway elevational view of a second embodiment of a diluent injection burner apparatus of the present invention.

FIG. 6 is a pictorial representation of a flame envelope produced during combustion of gaseous fuels in the diluent injection burner apparatus of the present invention and illustrating a diluent shroud formed about a base portion of the flame envelope.

DETAILED DESCRIPTION

Figure 1:
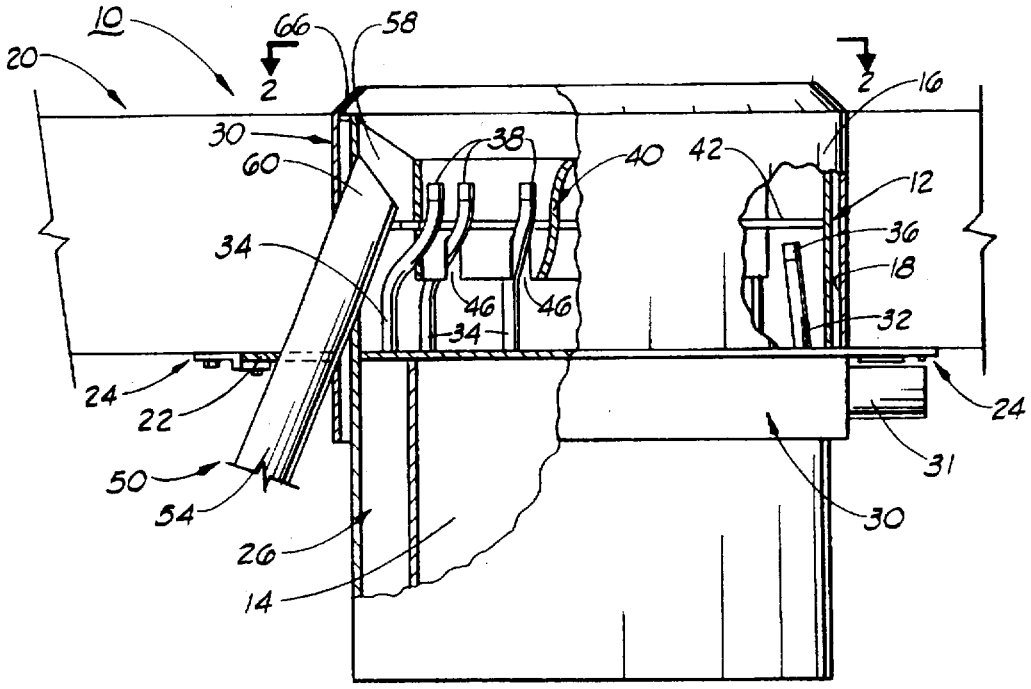
FIG. 1 is a semi-detailed, partially cutaway elevational view of a diluent injection burner apparatus constructed in accordance with the present invention.
Figure 2:
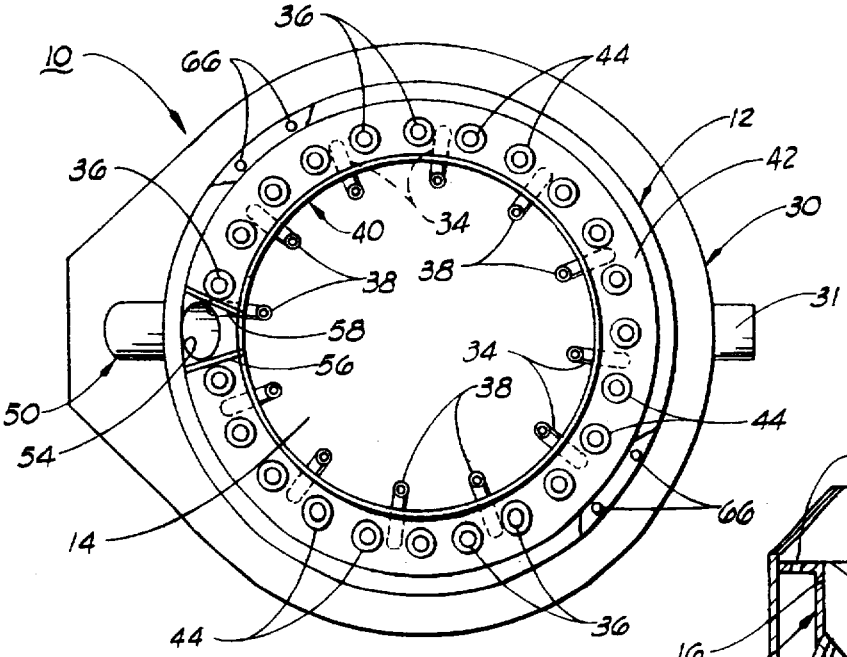
FIG. 2 is a plan view of the diluent injection burner apparatus taken at 2—2 in FIG. 1.

Referring now to FIGS. 1 and 2, shown therein is a diluent injection burner assembly 10 constructed in accordance with the present invention. The diluent injection burner assembly 10 is provided with a substantially cylindrically shaped burner head 12 having an airflow passage 14 extending therethrough. A downstream end portion 16 of the burner head 12 is disposed within an opening 18 formed in a firebox or boiler 20; and the diluent injection burner assembly 10 is secured to the firebox or boiler 20 via a connector plate 22 supported by the burner head 12 and a plurality of connector assemblies 24 substantially as shown in FIG. 1.

A fuel gas manifold 26 is disposed within an upstream end portion 28 of the burner head 12; and a diluent manifold 30 having an inlet conduit 31 is disposed about the burner head 12 so as to extend from a medial portion of the burner head 12 to the downstream end portion 16 thereof.

A plurality of first fuel dispensing lines 32 are connected to and in fluid communication with the fuel gas manifold 26; and a plurality of second fuel dispensing lines 34 are connected to the fuel gas manifold 26 so that fluid communication is established therebetween. Each of the first fuel dispensing lines 32 supports a primary fuel dispensing nozzle 36; and each of the second fuel dispensing lines 34 supports a secondary fuel dispensing nozzle 38. The primary fuel dispensing nozzles 36 are peripherally disposed about an outer portion of the burner head 12, and the secondary fuel dispensing nozzles 38 are also peripherally disposed about the burner head 12 so as to be positioned inwardly from the primary fuel dispensing nozzles 36. It should be noted that the length of the first fuel dispensing lines 32 which support the primary fuel dispensing nozzles 36 is less than the length of the second fuel dispensing lines 34 which support the secondary fuel dispensing nozzles 38. Thus, the fuel is injected via the primary fuel dispensing nozzles 36 into the downstream end portion 16 of the burner head 12 at a position upstream of the discharge of the fuel into the burner head 12 via the secondary fuel dispensing nozzles 38. By injecting fuel through the primary fuel dispensing nozzles 36 upstream of fuel injected through the secondary fuel dispensing nozzles 38 a substantially layered effect is achieved during ignition of the fuel and a shroud of diluent can be formed about the base portion of a flame envelope developed upon ignition of the fuel.

The diluent injection burner assembly 10 has an inner fire cylinder 40 which is disposed in the airflow passage 14 near the downstream end portion 16, and is secured therein by an annular plate 42. The annular plate 42 is disposed immediately downstream of the primary fuel dispensing nozzles 36, and a plurality of fuel clearance apertures or openings 44, equal in number to that of the primary fuel dispensing nozzles 36, are provided to permit passage of fuel dispensed from the primary fuel dispensing nozzles 36. A plurality of slots 46 are disposed in and about the inner fire cylinder 40, and the second fuel dispensing lines 34 extend therethrough as shown.

The diluent injection burner assembly 10 also comprises an ignition assembly 50 for igniting fuel dispensed through the primary and secondary fuel dispensing nozzles 36, 38 in the downstream end portion 16 of the burner head 12 so that a flame envelope 52 (FIG. 6) produced thereby extends into the firebox or boiler 20. The ignition assembly 50 comprises a pilot fuel line 54 connected to and in fluid communication with a fuel source (not shown) and a pair of spatially disposed shield members 56, 58 disposed along opposite sides of a distal end portion 60 of the pilot fuel line 54 so as to protect the distal end portion 60 from the heat of the combusted fuel in the downstream end portion 16 of the burner head 12.

Ignition of the fuel dispensed from the primary and secondary fuel dispensing nozzles 36, 38 produces the flame envelope 52 (FIG. 6) which extends from the downstream end portion 16 of the burner head 12 into the firebox or boiler 20. In order to reduce the amount of oxides of nitrogen present in the combustion effluent resulting from combustion of the fuel, an inert diluent, such as steam, is injected about a lower or base portion 62 of the flame envelope 52 from the diluent manifold 30 so that a shroud 64 of inert diluent is formed around the base portion 62 of the flame envelope 52.

Figure 3:
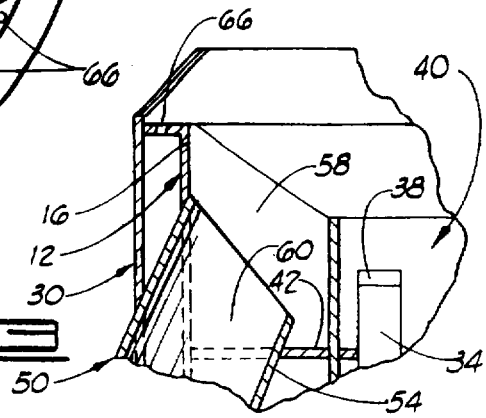
FIG. 3 is an enlarged, semi-detailed, cutaway fragmental view of a downstream end portion of the diluent injection burner apparatus of FIG. 1.

In order to produce the inert shroud 64, the diluent manifold 30 is provided with a plurality of dispensing apertures 66 which are disposed in the downstream end of the diluent manifold 30 peripherally about the primary fuel dispensing nozzles 36, and thus about the secondary fuel dispensing nozzles 38. As more clearly shown in FIG. 3, the dispensing apertures 66 are disposed so that the inert diluent is dispensed therethrough generally tangentially to the flame envelope 52 which assists in the forming of the diluent shroud 64 about the base portion 62 of the flame envelope 52.

In operation of the diluent injection burner assembly 10, a major portion of fuel is dispensed through the primary fuel dispensing nozzles 36, while a minor portion of the fuel is dispensed through the secondary fuel dispensing nozzles 38. Once a stable flame envelope has been formed by combustion of the fuel, the pilot flame is quenched and, in some applications, the fuel to the primary fuel dispensing nozzles 36 is reduced and or eliminated during operation of the diluent injection burner assembly 10.

Shown in FIG. 4 is a diluent injection burner assembly 10A identical in construction to that of the diluent injection burner assembly 10 previously described, except as noted. Combustion air to support combustion and stabilization of the flame envelope 52 is supplied via the airflow passage 14 extending through the burner head 12. In order to enhance the stability of the flame envelope 52, and to control air flow, a diffuser plate 68 is disposed in the airflow passageway 14 as shown in FIG. 4. Thus, the flow of combustion air is diffused prior to admixture with the fuel gas in the downstream end portion 16 of the burner head 12. The diffuser plate 68 is secured within the airflow passageway 14 via a plurality of connector brackets (not shown) in a conventional manner and the diffuser plate 68 is positioned upstream of the secondary fuel dispensing nozzles 38.

Referring now to FIG. 5, a second embodiment of a diluent injection burner assembly 70 constructed in accordance with the present invention is illustrated. The diluent injection burner assembly 70 is similar in construction and function to the diluent injection burner assembly 10 previously described, with the exceptions that will be noted. The diluent injection assembly 70 comprises the burner head 12, the fuel gas manifold 26, the diluent manifold 30, primary and secondary fuel dispensing nozzles 36, 38 and the ignition assembly 50. The diluent injection burner assembly 70 further comprises a plurality of fuel lines each of which supports a tertiary fuel dispensing nozzle, such as fuel line 72 and tertiary fuel dispensing nozzle 74, which are peripherally disposed about the burner head 12 in the airflow passageway 14. The tertiary fuel dispensing nozzles 74 are spatially disposed inwardly from the primary fuel dispensing nozzles 36 and the secondary fuel dispensing nozzles 38.

It will be noted that the diluent injection burner assembly 70 also includes the diffuser plate 68 supported within the airflow passageway 14 of the burner head 12 so as to be disposed upstream of the secondary fuel dispensing nozzles 38 and the tertiary fuel dispensing nozzles 74. As previously stated, the diffuser plate 68 serves to enhance flame stability and to control the flow of combustion air through the airflow passage 14. While the burner assembly 70 has been illustrated as containing the diffuser plate 68, it is to be understood that under certain operating conditions it may be possible to eliminate the diffuser plate 68 from the burner assembly 70 without adversely affecting its operation.

Combustion of the fuel in the downstream end portion 16 of either the diluent injection burner assembly 10 or the diluent injection burner assembly 70 produces the flame envelope 52 pictorially illustrated in FIG. 6. It has been found during operation of the diluent injection burner assemblies 10 and 70 that injection of a low pressure inert diluent, such as steam, through the dispensing apertures 66 so that the diluent is discharged generally tangential to the surface of the flame envelope 52 produces the shroud 64 about the base portion 62 of the flame envelope 52. Formation of the diluent shroud 64 about the base portion 62 of the flame envelope 52 effectively reduces the nitrogen oxide content of the combustion effluent in boilers utilizing the diluent injection burner assembly 10 or 70 to less than about 25 ppm.

The mechanism which achieves the reduction of the nitrogen oxide content in the combustion effluent is not fully understood. However, it has been determined that desirable results are obtained when the pressure of the diluent in the diluent manifold 30, which is injected tangentially to the base portion 62 of the flame envelope 52, has a manifold pressure of about 4 to 5 psi. Further, it should be understood that while steam has been mentioned as the inert diluent, any inert diluent can be employed to form the shroud 64 about the base portion 62 of the flame envelope 52.

From the above description it is clear that the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A process for combusting fuel in a burner to produce a combustion effluent containing less than about 25 ppm oxides of nitrogen which comprises:

supplying a stream of combustion air to the burner;

injecting a first gaseous fuel portion into the burner;

injecting a second gaseous fuel portion into the burner downstream of the first gaseous fuel portion;

igniting the first and second gaseous fuel portions injected into the burner, producing a flame envelope; and injecting an inert diluent generally tangentially to the flame envelope downstream of the first and second gaseous fuel portions, forming a shroud of inert diluent about the base of the flame envelope.

2. The process of claim 1 wherein the inert diluent is injected through an annular diluent manifold surrounding the burner and having a plurality o dispensing apertures disposed to dispense the inert diluent generally tangentially to the flame envelope downstream of the first and second gaseous fuel portions, forming a shroud of inert diluent about the base of the flame envelope.

3. The process of claim 2 wherein the second gaseous fuel portion is injected inwardly from the first gaseous fuel portion.

4. The process of claim 3 further comprising:

injecting a third gaseous fuel portion into the burner downstream of the second gaseous fuel portion.

5. A burner apparatus comprising:

a burner head assembly having an airflow passage extending therethrough from an upstream end portion to a downstream end portion of the burner head assembly for supplying a stream of combustion air to the burner;

a primary fuel dispensing means for supplying a first gaseous fuel portion to the burner;

a secondary fuel dispensing means for supplying a second gaseous fuel portion to the burner downstream of the first gaseous fuel portion;

an ignition means for igniting the first and second gaseous fuel portions supplied to the burner, producing a flame envelope; and a diluent means, disposed peripherally about the primary fuel dispensing means, for injecting an inert diluent generally tangentially to the flame envelope downstream of the first and second gaseous fuel portions, forming a shroud of inert diluent about the base of the flame envelope.

6. The burner apparatus of claim 5 wherein the diluent means comprises:

an annular diluent manifold surrounding the burner head assembly and disposed peripherally about the primary fuel dispensing means, the diluent manifold having a plurality of dispensing apertures disposed to dispense the inert diluent generally tangentially to the flame envelope downstream of the first and second gaseous fuel portions, forming a shroud of inert diluent about the base of the flame envelope.

7. The burner apparatus of claim 6 wherein the secondary fuel dispensing means is disposed inwardly from the primary fuel dispensing means.

8. The burner apparatus of claim 7 further comprising a fuel manifold disposed substantially about the air flow passage and connected to the primary fuel dispensing means and to the secondary fuel dispensing means, for supplying gaseous fuel to the burner.

9. The burner apparatus of claim 8 wherein the primary fuel dispensing means comprises:

a plurality of primary fuel dispensing lines operably connected to the fuel manifold;

a plurality of primary fuel dispensing nozzles peripherally disposed about the burner head assembly, each primary fuel dispensing nozzle connected to one of the primary fuel dispensing lines.

10. The burner apparatus of claim 9 wherein the secondary fuel dispensing means comprises:

a plurality of secondary fuel dispensing lines operably connected to the fuel manifold;

a plurality of secondary fuel dispensing nozzles peripherally disposed about the burner head assembly and disposed inwardly from the primary fuel dispensing nozzles, each secondary fuel dispensing nozzle connected to one of the secondary fuel dispensing lines and disposed downstream of the primary dispensing nozzles.

11. The burner apparatus of claim 10 wherein the ignition means comprises:

a fuel source;

a pilot fuel line in fluid communication with the fuel source, the pilot fuel line having a distal end disposed near the primary and secondary fuel dispensing nozzles; and shield means for shielding the distal end of the pilot fuel line from the heat of the flame envelope.

12. The burner apparatus of claim 11 further comprising:

diffuser means disposed within the airflow passage of the burner head assembly upstream of the primary fuel dispensing means for diffusing the combustion air prior to admixture with the first and second gaseous fuel portions.

13. The burner apparatus of claim 12 further comprising:

baffle means for separating the primary fuel dispensing nozzles and the secondary fuel dispensing nozzles in the burner head assembly.

14. The burner apparatus of claim 13 further comprising:

a tertiary fuel dispensing means for supplying a third gaseous fuel portion to the burner downstream of the second gaseous fuel portion.

* * * * *